US007244051B2

(12) United States Patent
Bewig et al.

(10) Patent No.: US 7,244,051 B2
(45) Date of Patent: Jul. 17, 2007

(54) LIGHT-GENERATING APPARATUS HAVING A REFLECTOR

(75) Inventors: Lars Bewig, Bad Gandersheim (DE); Ulrich Zierfas, Bad Gandersheim (DE); Torsten Holdmann, Wöllstein (DE)

(73) Assignee: Schott AG, Mainz (DE)

( * ) Notice: Subject to any disclaimer, the term of this patent is extended or adjusted under 35 U.S.C. 154(b) by 41 days.

(21) Appl. No.: 10/818,741

(22) Filed: Apr. 6, 2004

(65) Prior Publication Data

US 2004/0264197 A1 Dec. 30, 2004

(30) Foreign Application Priority Data

Apr. 9, 2003 (DE) ..... 103 16 506

(51) Int. Cl.
*F21V 7/20* (2006.01)

(52) U.S. Cl. ..... 362/345; 362/294

(58) Field of Classification Search ..... 362/296, 362/294, 345
See application file for complete search history.

(56) References Cited

U.S. PATENT DOCUMENTS

| | | | | |
|---|---|---|---|---|
| 1,899,272 | A | 2/1933 | Hertz | |
| 3,710,094 | A * | 1/1973 | Monte et al. | 362/218 |
| 3,936,686 | A * | 2/1976 | Moore | 362/294 |
| 4,780,799 | A * | 10/1988 | Groh | 362/294 |
| 4,885,668 | A * | 12/1989 | Maglica et al. | 362/345 |
| 4,933,823 | A * | 6/1990 | Taylor | 362/341 |
| 5,367,444 | A * | 11/1994 | Bornhorst et al. | 362/264 |
| 5,666,003 | A * | 9/1997 | Shibata et al. | 257/796 |
| 5,847,467 | A * | 12/1998 | Wills et al. | 257/789 |
| 5,947,590 | A | 9/1999 | Meuse et al. | 362/264 |
| 6,290,256 | B1 * | 9/2001 | McFarland et al. | 280/736 |
| 6,419,378 | B1 * | 7/2002 | Wedell et al. | 362/431 |
| 6,451,447 | B1 * | 9/2002 | Ragland et al. | 428/593 |
| 6,599,779 | B2 * | 7/2003 | Shim et al. | 438/122 |
| 6,654,399 | B1 * | 11/2003 | Kimura et al. | 372/50.1 |
| 6,807,906 | B1 * | 10/2004 | DeMoore et al. | 101/424.1 |
| 6,899,444 | B1 * | 5/2005 | Biber et al. | 362/345 |
| 2002/0141188 | A1 | 10/2002 | Basey | 362/294 |

FOREIGN PATENT DOCUMENTS

| | | |
|---|---|---|
| DE | 152169 | 6/1904 |
| DE | 1286473 | 1/1969 |
| DE | 109732 | 11/1974 |
| DE | 2352747 | 12/1976 |
| DE | 2645832 | 4/1978 |
| DE | 2647545 | 4/1978 |
| DE | 4211163 | 10/1993 |
| DE | 195 39 809 | 4/1997 |
| DE | 19830909 | 11/2000 |

(Continued)

OTHER PUBLICATIONS www.behr.com/behrx/glossary/glossary.jsp.*

*Primary Examiner*—Ali Alavi
*Assistant Examiner*—William J Carter
(74) *Attorney, Agent, or Firm*—Ohlandt, Greeley, Ruggiero & Perle, L.L.P.

(57) ABSTRACT

The invention envisages a light-generating apparatus that provides effective cooling of the reflector, the apparatus comprising a reflector and a device for improving the dissipation of heat from the reflector.

24 Claims, 3 Drawing Sheets

FOREIGN PATENT DOCUMENTS

| | | |
|---|---|---|
| DE | 2798986 | 3/2001 |
| EP | 0579555 | 7/1993 |
| GB | 395579 | 7/1933 |
| JP | 2002/184234 | 6/2002 |
| WO | 0751339 | 6/1996 |
| WO | WO03/021623 | 3/2003 |

* cited by examiner

LIGHT-GENERATING APPARATUS HAVING A REFLECTOR

BACKGROUND OF THE INVENTION

1. Field of the Invention

The invention relates in general to illuminating means, in particular the invention relates to a light-generating apparatus having a reflector and a cooling structure.

2. Description of Related Art

Attempts are being made, for example in the field of projection technology, to reduce the size of light-generating systems in conjunction with identical or increased power. This is desirable, inter alia, in order to achieve an increased brilliancy. Even today, use is still being made for projectors of predominantly conventional luminous means which operate, for example, with incandescent wires, or particularly with electric arcs. As high-brilliancy sources, these light sources are distinguished from lasers, in particular, by the high light power and the realistic color temperature and a high spectral blue component.

However, a large thermal component is lost with such light sources. Because of the thermal power that occurs, the light-generating systems or apparatuses cannot be of arbitrarily small configuration in order not to permit the thermal input per unit of area of the reflector to become too high. This problem is also compounded, in particular, in the case of cold-light reflectors, for which longer wave radiation components are not reflected but pass through the reflector. Further problems arise owing to the large change in temperature occurring during switching on and off.

SUMMARY OF THE INVENTION

It is therefore the object of the invention to provide a light-generating system, in particular a light-generating apparatus, that yields an improvement with regard to the above-named problems. This object is achieved in a most surprisingly simple way simply by the subject matter of the independent claims. Advantageous refinements and developments are specified further in the subclaims.

Consequently, the invention envisages a light-generating apparatus that comprises a reflector, and a device for improving the dissipation of heat from the reflector.

In accordance with a preferred embodiment of the invention, a light-generating apparatus is provided in which the device for improving the dissipation of heat is connected to the rear side of the reflector or is arranged thereon. The rear side or outside of the reflector is understood in this case to be a side of the reflector averted from the luminous means or from the site provided for the luminous means.

It is particularly advantageous for an effective dissipation of heat when the device for improving the dissipation of heat comprises a radiation-absorbing surface.

In particular, in this case the device for improving the dissipation of heat can comprise a radiation-absorbing coating, it being particularly expedient when the coating absorbs in the infrared region, in particular in the spectral region the thermal radiation. Such a coating can be applied in a simple way to materials of a reflector body that are non-absorbing or weakly absorbing, such as a spherical glass cap.

The thermal radiation emitted by the reflector or passing through the reflector can be absorbed there in a targeted fashion by means of such a radiation-absorbing surface or coating, and so improved cooling can be achieved at the radiation-absorbing surface.

A preferred development envisages furthermore, that the coating absorbing thermal radiation is arranged on the outside of the reflector. The coating can cover the entire outside or else one or more subregions.

In order to improve the dissipation of heat, a surface provided for cooling can also comprise eddy-generating structures. For example, the structures can be arranged on at least one region of the surface of the reflector. A preferred embodiment of the invention provides that the eddy-generating structures are arranged on the outside of the reflector.

Particularly suitable as eddy-generating structures are dimples or depressions that can be circular, for example. These are easy to produce and, in the case of an enveloping flow of a cooling fluid around a surface fitted with such structures, the formation of eddies means that they ensure effective thorough mixing of cold and hot fluid layers, and thus lead to more effective heat exchange.

The reflector can also advantageously be fitted with a self-cleaning surface. This prevents the deposition of contaminants that can, inter alia, disadvantageously impede the dissipation of heat. Self-cleaning properties can also be achieved, inter alia, by the above-named eddy-generating structures, the formation of eddies preventing the production of dead flow zones, and thus the deposition of contaminants, such as dust, for example.

In a further preferred development of the light-generating apparatus, the device for improving the dissipation of heat comprises a heat sink connected to the reflector, in order thus to enlarge the effective cooling surface.

The heat sink can have a shape matched to the reflector including, in particular, in the region of the connection with the reflector, in order to improve the conduction of heat from the reflector into the heat sink.

It is also advantageous when the device for improving the dissipation of heat comprises a thermally conducting layer arranged on the reflector, in particular on the outside of the reflector. Said layer ensures an improved distribution and dissipation of the incident thermal power. For example, a reflector can be provided with a metallic coating for this purpose. In addition to an improved dissipation of heat, such a coating also ensures an increased resistance to cyclic temperature stress, since the heat can be distributed more quickly over the reflector body or parts of the reflector body, and temperature stresses in the reflector material can be avoided.

In particular, it is also advantageous when the reflector is provided with a coating that comprises two layers, a first layer absorbing radiation, and a second layer, arranged over the first layer, being highly thermally conductive. In this way, a reflection of the radiation by the first layer can be avoided, and the radiant power can be introduced in a targeted fashion in this layer, the second layer then ensuring a more uniform temperature distribution along the coated surface. In accordance with a variant of this embodiment of the invention, this layer is also arranged on the outside of the reflector.

The device for improving the dissipation of heat can also advantageously comprise a CVD and/or PVD coating of the reflector. This layer can, in particular, comprise a radiation-absorbing and/or thermally conducting layer. CVD and PVD coatings can be produced in a wide diversity of materials and readily as absorbing layers. For example, it is possible for this purpose to deposit a silicon oxide layer with a high carbon fraction, in particular with amorphous carbon, which has good absorption properties. The CVD coating can also have one or more metal oxides, oxides of the metals of titanium, tantalum and niobium, inter alia, being suitable.

The method of PVD coating is also expedient in order, for example, to deposit metal layers.

Instead of or in addition to a highly thermally conducting coating of the reflector, the device for improving the dissipation of heat can also advantageously comprise a metal foil brought into contact with the reflector. Bringing into contact can be accomplished, inter alia, by bonding on or clamping between the reflector and a further part.

The light-generating apparatus preferably also has air cooling, in order to absorb heat from components of the device for improving the dissipation of heat. The air cooling can, of course, also itself be part of the device for improving the dissipation of heat. The air cooling can, for example, comprise a ventilator, and/or be configured as convective cooling.

The light-generating apparatus can itself comprise at least one luminous means or be configured appropriately to be equipped with a luminous means. Suitable luminous means are, for example, ultra high pressure lamps such as, in particular, short-arc lamps, or halogen lamps.

Particular improvements by means of an inventive apparatus also especially result in the use of a cold-light reflector, since here a large part of the thermal radiation passes through the reflector and must be dissipated downstream of the reflector, or otherwise surfaces situated behind the reflector are strongly heated.

In an advantageous development, the inventive apparatus can also be fitted with a housing. For safety reasons, the housing can expediently be configured as an antishatter housing, particularly when use is made of ultra high pressure lamps. Furthermore, the housing can also have at least one light-shielded opening through which the cooling air can be fed without light, which, for example, passes into the housing body through the reflector or through cutouts therein, passing to the outside through the housing opening.

In order to connect parts of the device for improving the dissipation of heat to the reflector while producing a good thermal contact, the device can also comprise a thermal connection to the reflector with the aid of a thermolube, or can be connected to the reflector via a thermolube layer. For example, a thermolube can be introduced between the reflector and a heat sink or a heat-distributing metal foil.

Good thermal contact can also be achieved with the aid of an inventive cup that is resilient and/or matched to the shape of the reflector of the device for improving the dissipation of heat, and which clings to the reflector.

A multiplicity of materials such as, for example, metal, glass or glass ceramic are suitable for the reflector. Even plastics can be used because of the improved dissipation of heat provided by the invention. These can include, for example, at least one of the plastics of polycarbonate, polyetherimide, polymethyl methacrylate, cyclic olefin, olefin copolymer, or polyether sulfone.

However, it is also possible to use composite materials for the reflector such as, for example, a composite material consisting of one or more of the above-named plastics with a metal material.

The invention also envisages providing a reflector that is fitted with a device for improving the dissipation of heat and, in particular, can also be suitable for use in an inventive apparatus.

In accordance with one embodiment of the invention, the device for improving the dissipation of heat from the inventive reflector can comprise a coating at least on one region of a surface of the reflector. A preferred development provides that the coating is arranged on the outside of the reflector. In order to improve the dissipation of heat, the coating can advantageously absorb radiation, in particular thermal radiation or infrared radiation.

An advantageous development of such a reflector provides that the coating comprises a highly thermally conductive layer in order to achieve a better distribution of the thermal power on and in the reflector.

The device for improving the dissipation of heat can also have surface-enlarging cooling structures of the reflector body, such as, for example, cooling ribs or knobs, in order to increase the cooling power.

The invention is explained in more detail below with the aid of exemplary embodiments and with reference to the drawings, identical and similar elements being provided with the same reference numerals, and the features of various embodiments being combined with one another.

DETAILED DESCRIPTION OF THE INVENTION

Figure 1:
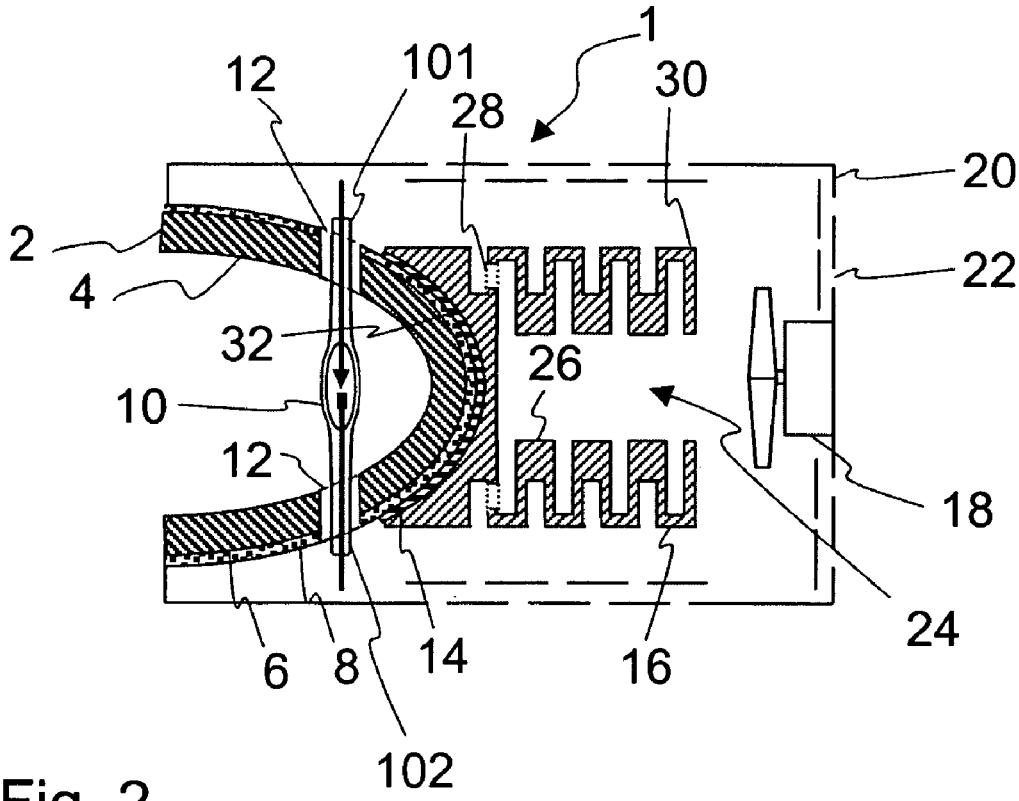
FIG. 1 shows a schematic sectional illustration of an embodiment of an inventive light-generating apparatus.

FIG. 1 depicts a cross sectional illustration through an embodiment of an inventive light-generating apparatus that is denoted as a whole by the reference numeral 1.

The light-generating apparatus 1 comprises a reflector 2 with an inside 4 and an outside 6, as well as a device for improving the dissipation of heat from the reflector 2. The inside 4 is concavely curved so that light from a luminous means that is arranged in or in front of the cavity defined by the curve inside is focused by reflection from the surface of the inside 4.

The reflector can be produced from metal, glass, glass ceramic or plastic, or can comprise a composite material made from two or more of these materials. The plastics of polycarbonate, polyetherimide, polymethyl methacrylate, cyclic olefin, olefin copolymer, or polyether sulfone, in particular, can be used as material for a plastic reflector or a reflector having a composite reflector body. The reflector 2 of the embodiment shown in FIG. 1 is also preferably designed as a cold-light reflector.

A luminous means 10 is arranged at a focal point of the concave inside 4 of the spherical reflector surface. The luminous means 10 in this embodiment comprises an ultra high pressure lamp whose connection legs 101, 102 are guided through cutouts 12 in the reflector 2.

In the case of this embodiment of the invention, the device for improving the dissipation of heat is connected to the rear side of the reflector. The device for improving the dissipation of heat comprises a coating 8 on the outside 6 of the reflector. This coating is designed as a coating that absorbs thermal radiation. This coating can be produced, for example, by CVD coating of the reflector, or can also comprise a PVD coating. CVD and PVD coating can also be used in a simple way in order, in particular, to deposit multiple coatings, for example by varying the composition of the process gas during coating.

Thermal radiation that is emitted by the luminous means 10 during operation of the apparatus passes through the reflector body and is then absorbed on the rear side or outside 6 by the coating 8 serving as a surface absorbing thermal radiation. The result of this is also to prevent retro-reflection of the thermal radiation, and so the coating 8 produces a reduction in the thermal radiation components in the spectral distribution of the light cone emitted by the apparatus.

Apart from the property of serving as light-absorbing surface, the coating 8 can also serve to improve the thermal distribution when the coating 8 comprises a thermally conducting layer. This leads not only to a targeted absorption of radiant energy, which can then be dissipated from the layer 8, but also, inter alia, to an improved resistance to cyclic temperature stress from the reflector 2.

In order to be able to dissipate the thermal power occurring during operation in the coating 8 owing to absorption and thermal conduction, the device for improving the dissipation of heat also comprises a heat sink 16. The latter is connected to a region of the outside 6 of the reflector, or to the coating 8 on the outside 6 of the reflector. In the region of the connection with the reflector, the heat sink 16 has a holding cup 32 for the reflector, whose surface has a shape matched to the reflector. Consequently, the contact surface between the heat sink 16 and reflector 2 is enlarged for effective cooling.

A thermal connection with the aid of thermolube 14 is present between the heat sink 16 and reflector in order additionally to improve the thermal contact.

Moreover, in this embodiment of the inventive light-generating apparatus air cooling is also provided as a component of the device for improving the dissipation of heat from the reflector. This device comprises a ventilator 18 that draws in an airstream and blows it onto the heat sink or generates an airstream flowing around the heat sink by virtue of the fact that it draws in air from the direction of the heat sink. The heat sink has a channel 24 through which the air from the ventilator 18 can flow and can escape again through openings 28. Inner cooling ribs 26 in the channel 24 ensure additional heat exchange. The cooling is additionally aided by outer cooling ribs 30.

Figure 2:
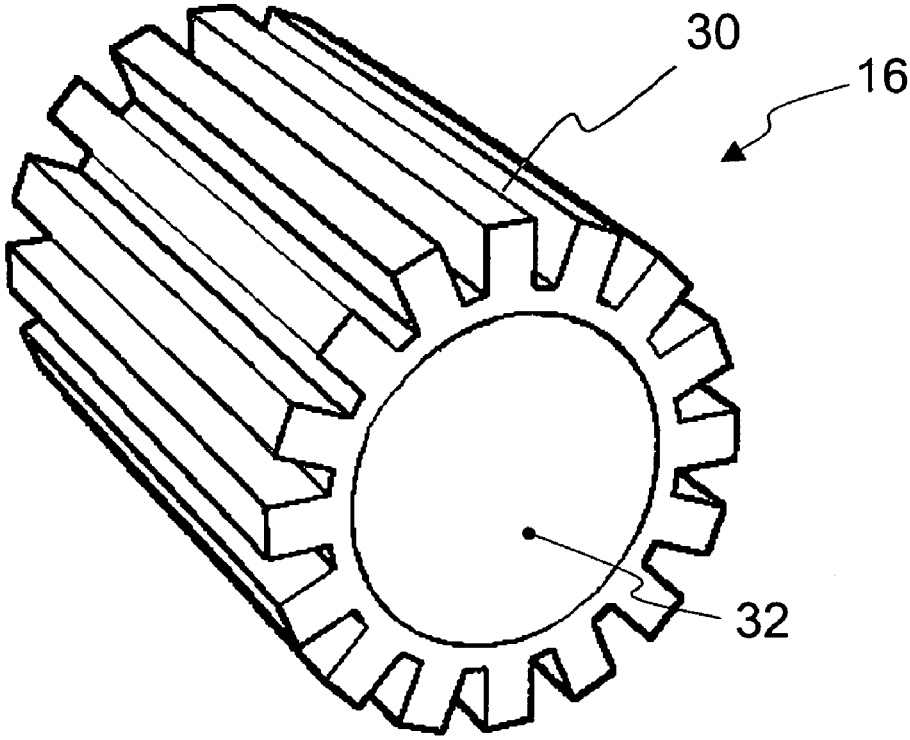
FIG. 2 shows an embodiment of a heat sink.

Otherwise than illustrated schematically in FIG. 1, the cooling ribs 26 and 30 can also run along the direction of flow of the airstream generated by the ventilator 18. Again, the heat sink can be of solid configuration, that is to say without a channel 24, and this reduces the outlay on fabrication, inter alia. Such a heat sink is illustrated in a perspective view in FIG. 2. The cooling ribs 30 run along the axis of symmetry of the body in the case of the cylindrical heat sink 16 shown in FIG. 2.

The surface of the heat sink 16 can additionally comprise one or more surfaces with eddy-generating structures. Examples of such eddy-generating structures are defined rough areas or depressions.

In the embodiment shown in FIG. 1, the light-generating apparatus 1 also comprises a housing 20. This housing 20 can serve as antishatter protection, something which is particularly advantageous when ultra high pressure lamps are used as luminous means.

The housing 20 also has a multiplicity of light-shielded openings 22 that enables exchange of air for cooling and at the same time prevents the light that enters the housing through the openings 12 in the reflector 2, for example, from passing to the outside. For this purpose, the openings 22 can be provided with suitable stops which block a direct exit of light.

Figure 3:
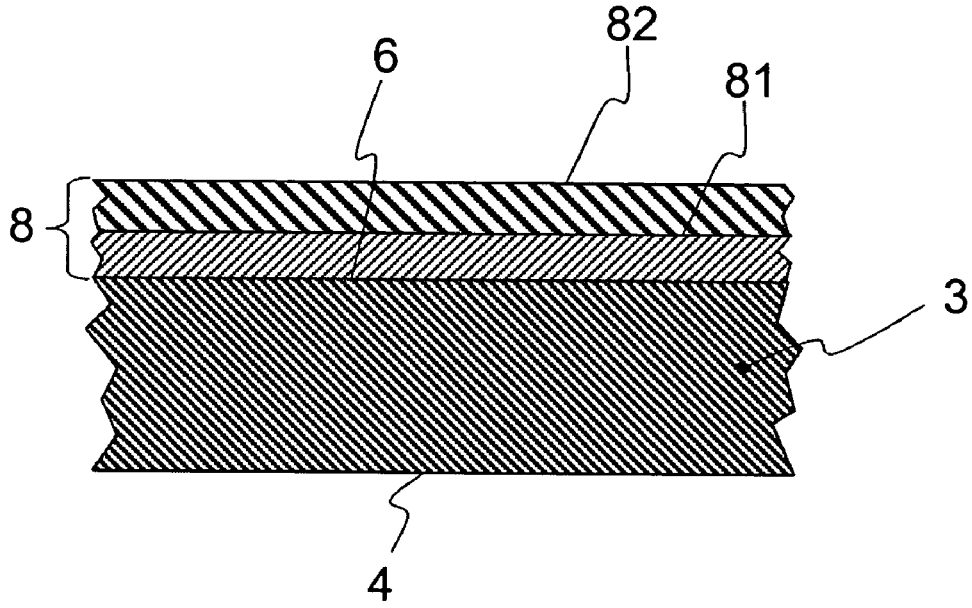
FIG. 3 shows a detail of a coated reflector in cross section.

FIG. 3 illustrates in cross section a detail of a coated reflector 2. In a similar way to that of the embodiment shown in FIG. 1, the substrate or the reflector body 3 is provided with a coating 8 on the outside 6 of the reflector. The coating 8 both absorbs radiation and is also highly thermally conducting. For this purpose, the coating 8 has a first layer 81 which is applied to the reflector body 3, and a second layer 82, applied over the first layer 81. The first layer 81 absorbs radiation, this property applying, in particular, to the thermal radiation components emitted by the luminous means. The radiation-absorbing property can be achieved, for example, by means of a high layer roughness and/or an adequate fraction of amorphous carbon in the layer.

The second layer 81, arranged thereon, is highly thermally conductive. For example, this layer 82 can comprise a suitable metal. The first layer 81 prevents substantial radiation components being retoreflected by the second layer 82, and thus being able to supply a spectral contribution again in the case of a cold-light reflector, for example.

Figure 4:
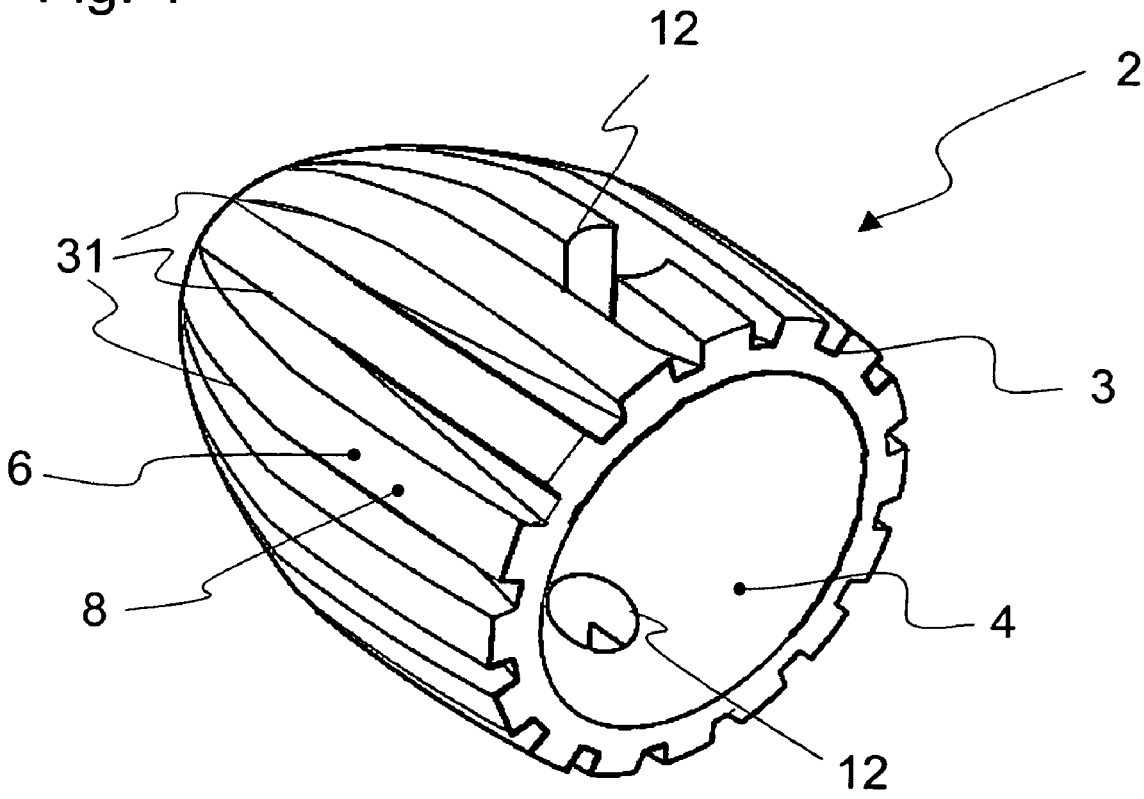
FIG. 4 shows an embodiment of an inventive reflector.

FIG. 4 shows an embodiment of an inventive reflector 2 that is fitted with a device for improving the dissipation of heat, and can also be used in an inventive apparatus 1, as is shown by way of example in FIG. 1. The reflector comprises a reflector body 3 with a concavely curved inside 4 that forms the reflecting surface of the reflector 2 for the light emitted by a luminous means, the inner surface 4 being fitted, for example, with a radiation-reflecting coating. This can be designed as an interference filter or dielectric mirror that reflects visible light in the manner of a cold-light reflector and transmits light of longer wavelength.

In this embodiment, the device for improving the dissipation of heat comprises surface-enlarging cooling structures of the reflector body 3 in the form of cooling ribs 31 on the outside 6. In this embodiment, the cooling ribs 31 extend, for example, along the axis of symmetry of the reflector body 3. This configuration is advantageous, inter alia, whenever use is made in addition of air cooling with a ventilator that generates an airstream in the direction of the axis of symmetry. In addition to the cooling ribs, the reflector 2 can also have eddy-generating structures on the outside 6 in order to improve the thorough mixing of the air during cooling.

In a similar way to the embodiment shown in FIG. 1, there are present in the reflector body 3 openings 12 that enable the luminous means to be held and arranged in the reflector in front of the inside 4.

Furthermore, the device for improving the dissipation of heat comprises a coating 8 at least of a region of the outside of the reflector 2. Like the coating shown in FIG. 3, the coating 8 can in this case advantageously be provided with a lower, radiation-absorbing layer 8 and a second layer 82 covering this first layer 81, the second layer 82 being highly thermally conductive and having an equalizing temperature.

Figure 5:
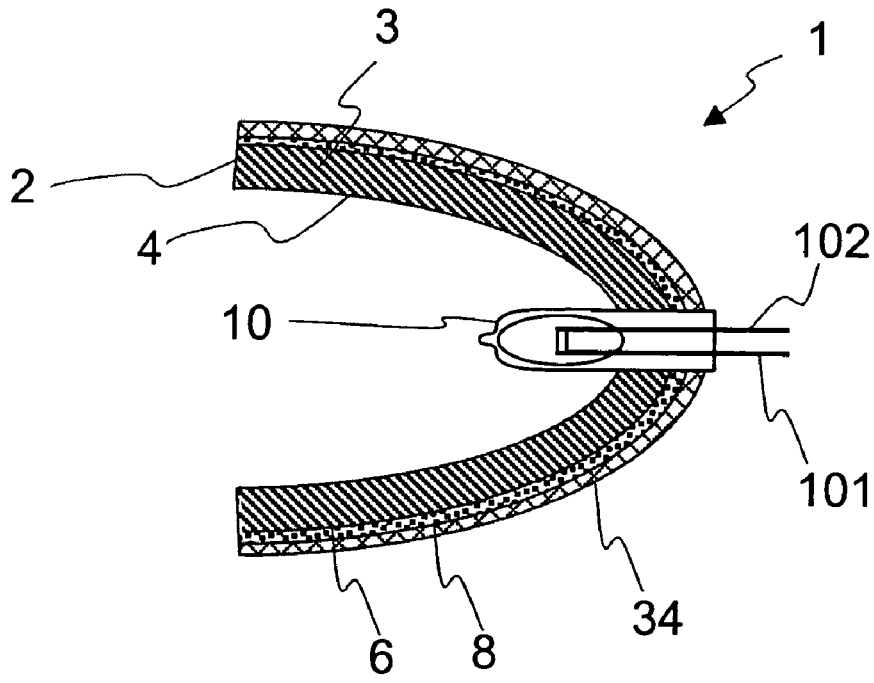
FIG. 5 shows a further embodiment of an inventive reflector with integrated luminous means.

A further embodiment of an inventive reflector 2, or a light-generating apparatus 1 is illustrated in FIG. 5. In this embodiment for the invention, the luminous means 10 is integrated in the reflector 2. As illustrated, the luminous means can be, for example, a halogen lamp or else an ultra high pressure lamp again. Likewise as with the embodiments described above, the reflector 2 is provided on its outside 6 with a coating 8 as a component of a device for improving the dissipation of heat. The coating 8 serves the purpose of absorbing radiation and can also have thermally conducting properties.

In addition to the coating 8, there is applied to the outside 6 as a further component of the device for improving the dissipation of heat a thermally conducting metal foil 34 that is in contact with the reflector 2 or with the coated outside 6 thereof. On the basis of its bendability and flexibility, the metal foil 34 can cling effectively to the shape of the reflector 2 and serves the purpose of better distribution of the thermal power, particularly on the outside 6 of the reflector.

Figure 6:
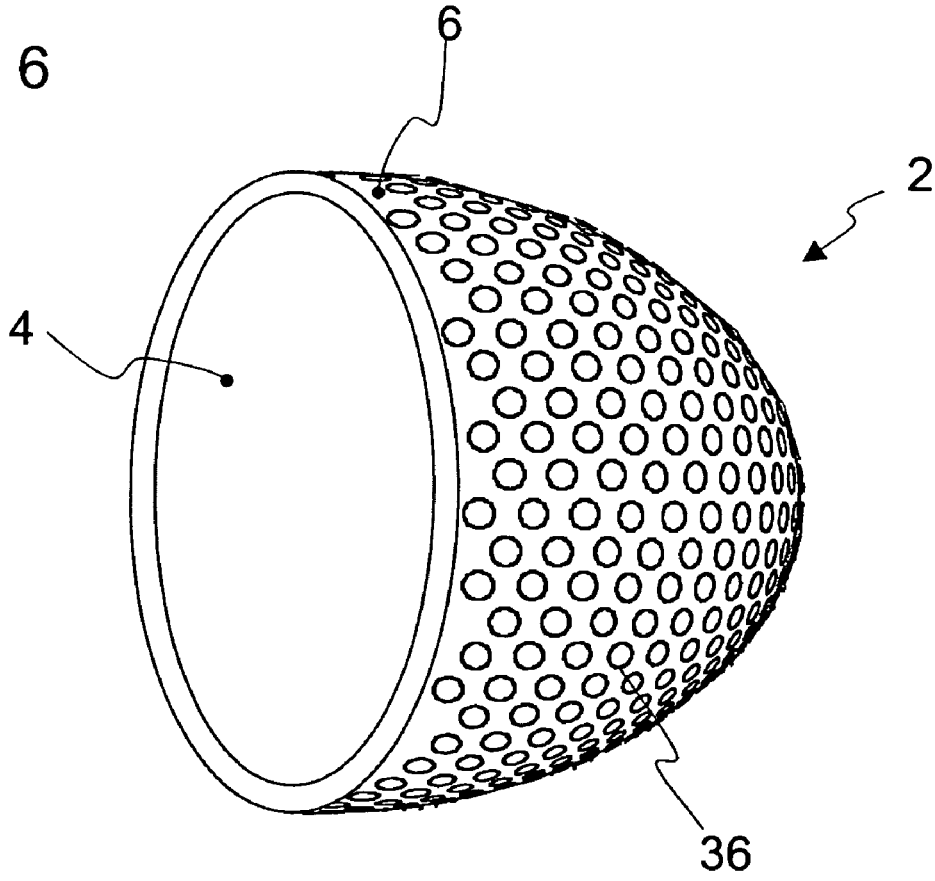
FIG. 6 shows an embodiment of a reflector according to the invention with eddy-generating structures.

FIG. 6 shows a further, preferred embodiment of a reflector 2 according to the invention. In this embodiment, the device for improving the dissipation of heat comprises eddy-generating structures in the form of dimples or depressions 36 that can be circular, for example, and are arranged on the outer surface 6 of the reflector. The depressions 36 can be arranged, for example, in a regular pattern, by way of example in the shape of a hexagonal matrix, on the outer surface 6 or a subregion of the outer surface 6. When a cooling fluid such as, in particular, air flows around the reflector the depressions ensure intensive formation of eddies in the fluid, and thus an improved heat exchange of the surface of the reflector 2 with the cooling fluid.

It is evident to the person skilled in the art that the above-described embodiments are to be understood as exemplary, and that the invention is not limited to them, but can be varied in multifarious ways without departing from the scope of the invention.

What is claimed is:

1. A light-generating apparatus comprising:

a reflector having a reflector substrate; and a device for improving heat dissipation from the reflector, the device for improving heat dissipation having a coating that absorbs thermal radiation, wherein the coating is applied to an outside portion of the reflector substrate, wherein the device for improving heat dissipation comprises a surface having a plurality of eddy generating structures, and wherein the plurality of eddy-generating structures comprises a plurality of circular depressions.

2. The light-generating apparatus as claimed in claim 1, wherein the device for improving heat dissipation further comprises a heat sink connected to the coating in a region of the reflector.

3. The light-generating apparatus as claimed in claim 2, wherein the heat sink has a shape corresponding to a shape of the region of the reflector.

4. The light-generating apparatus as claimed in claim 3, wherein the heat sink comprises a cup clinging to the reflector.

5. The light-generating apparatus as claimed in claim 4, wherein the cup comprises a resilient material.

6. The light-generating apparatus as claimed in claim 4, wherein the cup has the shape that corresponds to the shape of the reflector.

7. The light-generating apparatus as claimed in claim 2, wherein the device for improving heat dissipation comprises a thermolube connection between the heat sink and the coating.

8. The light-generating apparatus as claimed in claim 1, wherein the coating comprises a thermally conducting layer.

9. The light-generating apparatus as claimed in claim 1, further comprising an air cooling device.

10. The light-generating apparatus as claimed in claim 9, wherein the air cooling device comprises a ventilator or convective cooling device.

11. The light-generating apparatus as claimed in claim 1, further comprising at least one luminous device.

12. The light-generating apparatus as claimed in claim 11, wherein the at least one luminous device comprises a short-arc lamp or a halogen lamp.

13. The light-generating apparatus as claimed in claim 1, wherein the reflector comprises a cold-light reflector.

14. The light-generating apparatus as claimed in claim 1, further comprising an antishatter housing.

15. The light-generating apparatus as claimed in claim 1, further comprising a housing having at least one light-shielded opening.

16. The light-generating apparatus as claimed in claim 1, wherein the device for improving heat dissipation further comprises a metal foil in contact with the coating.

17. The light-generating apparatus as claimed in claim 16, wherein the reflector comprises at least one material selected from the group consisting of polycarbonate, polyether imide, polymethyl methacrylate, cyclic olefin, olefin copolymer, polyether sulfone, and any combinations thereof.

18. The light-generating apparatus as claimed in claim 1, wherein the reflector comprises at least one material selected from the group consisting of metal, glass, glass ceramic, plastic, and any combinations thereof.

19. The light-generating apparatus as claimed in claim 1, wherein the reflector comprises a composite material.

20. The light-generating apparatus as claimed in claim 1, wherein the coating comprises a CVD or PVD coating on the reflector.

21. The light-generating apparatus as claimed in claim 1, wherein the reflector has a self-cleaning surface.

22. The light-generating apparatus as claimed in claim 1, wherein the coating comprises a first layer absorbing radiation and a second layer arranged over the first layer, the second layer being thermally conductive.

23. The light-generating apparatus as claimed in claim 1, wherein the plurality of eddy generating structures are in at least one region of the surface of the reflector.

24. The light-generating apparatus as claimed in claim 1, wherein the device for improving heat dissipation comprises a plurality of surface-enlarging cooling structures.

* * * * *